US007975935B2

(12) United States Patent
Matheis, Jr.

(10) Patent No.: US 7,975,935 B2
(45) Date of Patent: Jul. 12, 2011

(54) COST EFFECTIVE PAINT SYSTEM

(75) Inventor: Kenneth Matheis, Jr., Lake Orion, MI (US)

(73) Assignee: Complete Automation, Inc., Lake Orion, MI (US)

( * ) Notice: Subject to any disclaimer, the term of this patent is extended or adjusted under 35 U.S.C. 154(b) by 554 days.

(21) Appl. No.: 12/101,584

(22) Filed: Apr. 11, 2008

(65) Prior Publication Data

US 2008/0257975 A1 Oct. 23, 2008

Related U.S. Application Data

(60) Provisional application No. 60/911,182, filed on Apr. 11, 2007.

(51) Int. Cl.
*B05B 17/00* (2006.01)

(52) U.S. Cl. ..... 239/1; 239/124; 239/289; 239/302; 239/304; 239/525; 52/79.1; 118/300

(58) Field of Classification Search ..... 239/1, 124, 239/127, 289, 302–304, 172, 525, 526; 52/79.1, 52/79.9; 118/300, 713
See application file for complete search history.

(56) References Cited

U.S. PATENT DOCUMENTS 4,562,791 A 1/1986 Porter
4,872,419 A * 10/1989 Blankemeyer et al. ..... 118/713
5,033,489 A * 7/1991 Ferre et al. ..... 52/79.1
5,309,403 A 5/1994 Bartow
6,651,392 B2 * 11/2003 Ritzal ..... 52/79.1
2002/0129566 A1 9/2002 Piccolo

FOREIGN PATENT DOCUMENTS

DE 19654931 A1 5/1998
WO 2004/080846 A1 9/2004

OTHER PUBLICATIONS

Notification Concerning Transmittal of International Preliminary Report on Patentability and the Report from the corresponding International Application No. PCT/US2008/060072 issued on Oct. 13, 2009. The documents were mailed to Applicant's attorney on Oct. 22, 2009.

* cited by examiner

*Primary Examiner* — Steven J Ganey
(74) *Attorney, Agent, or Firm* — Young, Basile, Hanlon & MacFarlane P.C.

(57) ABSTRACT

A paint system includes at least one modular paint delivery system module, each module having a shipping container configured for transport via a transport infrastructure, and at least one paint delivery system preassembled into an operational paint circulation unit and configured to be shipped and operated within the shipping container. A method for deploying a system includes building at least one modular paint delivery system module at a building site, each module having a shipping container configured for transport via a transport infrastructure, and at least one paint delivery system preassembled into an operational paint circulation unit and configured to be shipped to and operated within the shipping container at an installation site, transporting the module to the installation site location from the building site via the transport infrastructure, and connecting at least one resource connection and at least one distribution piping to the module at the installation site location.

20 Claims, 5 Drawing Sheets

COST EFFECTIVE PAINT SYSTEM

FIELD OF THE INVENTION

The present invention relates to a cost effective paint system, and more particularly, to a portable intermodal shipping container enclosing or housing a preassembled paint delivery system mounted within the container, where the paint delivery system is configured to be shipped and operated from within the container.

BACKGROUND

Intermodal shipping containers are large (8 feet by 8 feet by 40 feet is one typical size) and, when loaded, may weigh several tons. Such shipping containers must often be transferred to and from transport vehicles, such as vessels, truck trailers, and railroad cars. In some configurations, automatic latching mechanisms are installed in the corners of vessels, truck trailers, or railroad cars designed to transport intermodal shipping containers. These latching mechanisms can include a spring-loaded latch member which is adapted to engage a latching receptacle provided on the corresponding corners of a shipping container. The shipping containers are typically transferred to and from the vessel, truck trailer, or railroad car by large cranes.

Intermodal shipping containers, as used herein, refer to those that conform to International Standardization Organization (ISO) container manufacturing standards. In general, the intermodal shipping containers can be, for example, general purpose or dry, insulated, flat rack or platform, open top, refrigerated, or tank. General purpose containers, also referred to as cube containers, are enclosed, box-type containers used for general-purpose transportation. Cargo is typically loaded from one or both ends of the container. Insulated or thermal containers, with insulated walls but no refrigeration unit, are often used to transport chilled and frozen goods as well as temperature sensitive materials and products. Intermodal shipping containers also come in many other configurations, e.g., with one or more end and/or side doors and/or specially reinforced floors and/or frames for extra heavy loading. Generally, common container lengths used in international commerce include 20', 28', 40' and 48' as well as other sizes such as 10', 24', 44', 45', 46', 53', and 56'. Typical container height is 8'6" or 9'6" for high cube or extended height containers. The standard width for containers is 8'. Various other combinations of lengths, widths, and/or heights may also be employed. The containers may be made of, for example, steel, aluminum, or the like. Typically, because of weight constraints such as maximum load limits on highways, high density or heavy goods may be loaded in shorter containers. For example, a 40' container can have a typical container rating of approximately 67,000 pounds. Intermodal shipping containers generally have fittings on the top and bottom which facilitate in their handling and that enable them to be stacked in terminals, on ships, and/or in operation. The fittings primarily include oval-shaped holes at the lift points. For transport, storage or operation, containers may be stacked and connected to each other with interbox connectors (IBCs), i.e., pieces of hardware that fit into the oval holes of the containers above and below and are turned to lock the two containers together.

SUMMARY

According to one embodiment, a cost effective paint system generally includes at least one modular paint system module, each module including an intermodal shipping container and at least paint delivery system mounted within the container and configured to be shipped and operated within the container. Each paint delivery system is preassembled into an operational unit and interconnected to utility distribution and control systems located within the shipping container with external connectors provided for connection to utility resources and distribution piping located at the customer's site. The intermodal shipping container may be configured in accordance to International Organization for Standardization (ISO) container manufacturing standards or otherwise configured with respect to height, length, width, weight, and/or lifting points of the container for transport via an intermodal transport infrastructure. The modular design enables the modules to be factory built and easily transported to and deployed at a customers site.

For example, the intermodal shipping container can have a height of between approximately 8 feet and 10 feet, a width of between approximately 8 feet and 10 feet, and a length between approximately 10 feet and 56 feet. The continuous flow paint delivery systems can be arranged for human access within the intermodal shipping container. The modular continuous flow paint delivery systems can also include an interconnecting module to interconnect adjacent modular continuous flow paint delivery system modules. The modular components of the modular continuous flow paint delivery system need not employ intermodal shipping containers of the same size.

According to another embodiment, a modular continuous flow paint delivery system may generally include a modular continuous flow paint delivery system module including an intermodal shipping container configured for transport via an intermodal transport infrastructure with respect to height, length, width, weight, and/or lifting points of the container, one or more paint delivery systems of the same or various sizes preassembled into interconnected operational units mounted within the container and configured to be shipped and operated within the container, a power distribution system and control system preassembled into interconnected operational units mounted within the container and configured to distribute power from a power source to the paint delivery systems and to control operation of the paint delivery systems. By way of example and not limitation power distribution systems can include pneumatic systems with or without compressor, hydraulic systems with or without pumps, electrical systems with or without generators, or any combination thereof. Appropriate heating and/or cooling systems can also be preassembled into operational units within the container to be shipped and operated within the container.

According to yet another embodiment, a method for deploying a continuous flow paint delivery system generally includes building a modular continuous flow paint delivery system module including an intermodal shipping container configured in accordance to ISO container manufacturing standards and/or configured for transport via an intermodal transport infrastructure and paint delivery systems mounted within the intermodal container and configured to be shipped and operated within the intermodal container, transporting the modular computing module to a customer's site via an intermodal transport infrastructure, and connecting at least one local resource connection to the modular paint delivery system module.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
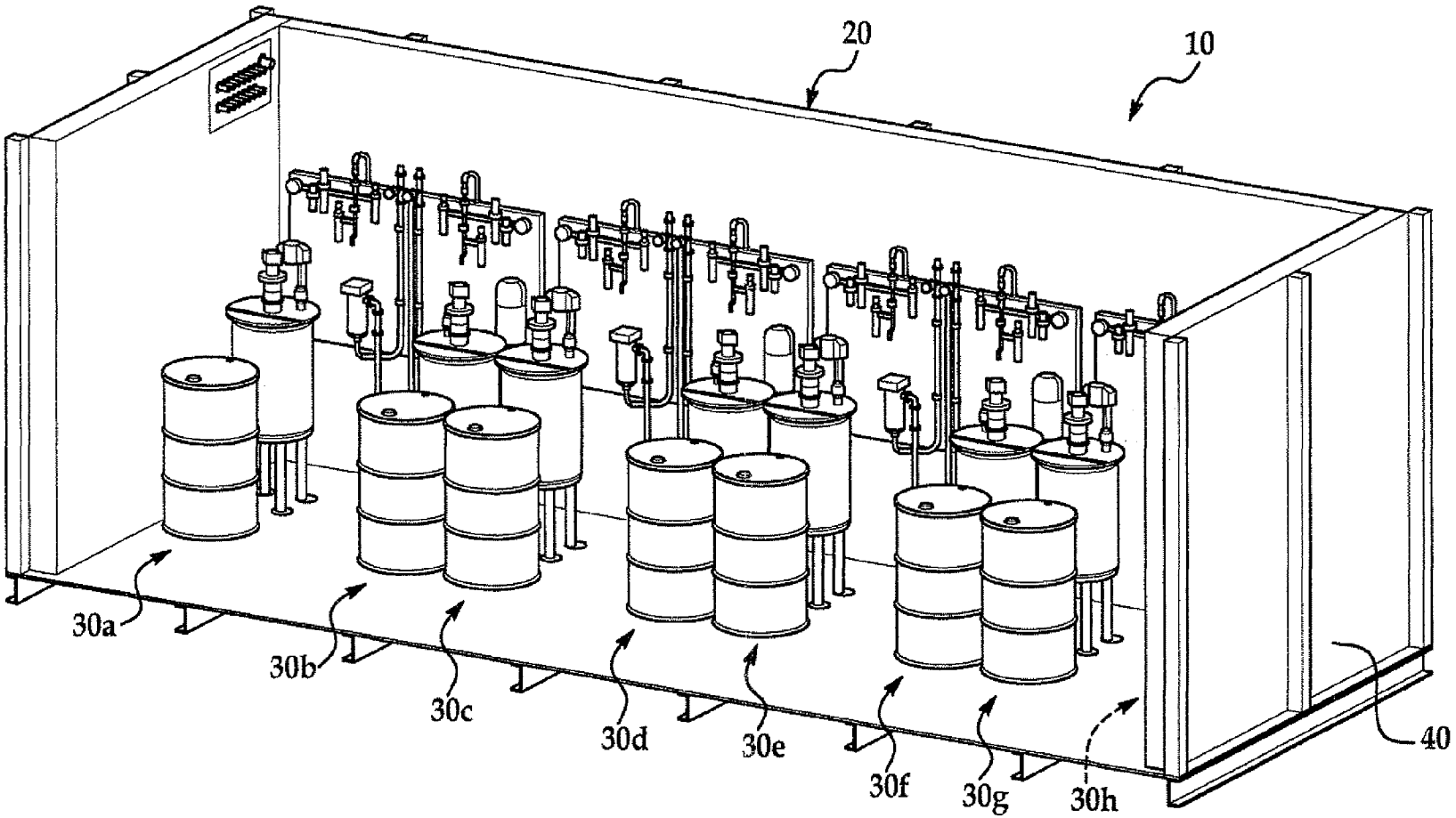
FIG. 1 is a perspective view of an illustrative implementation of a cost effective paint system according to one embodiment of the present invention.
Figure 2:
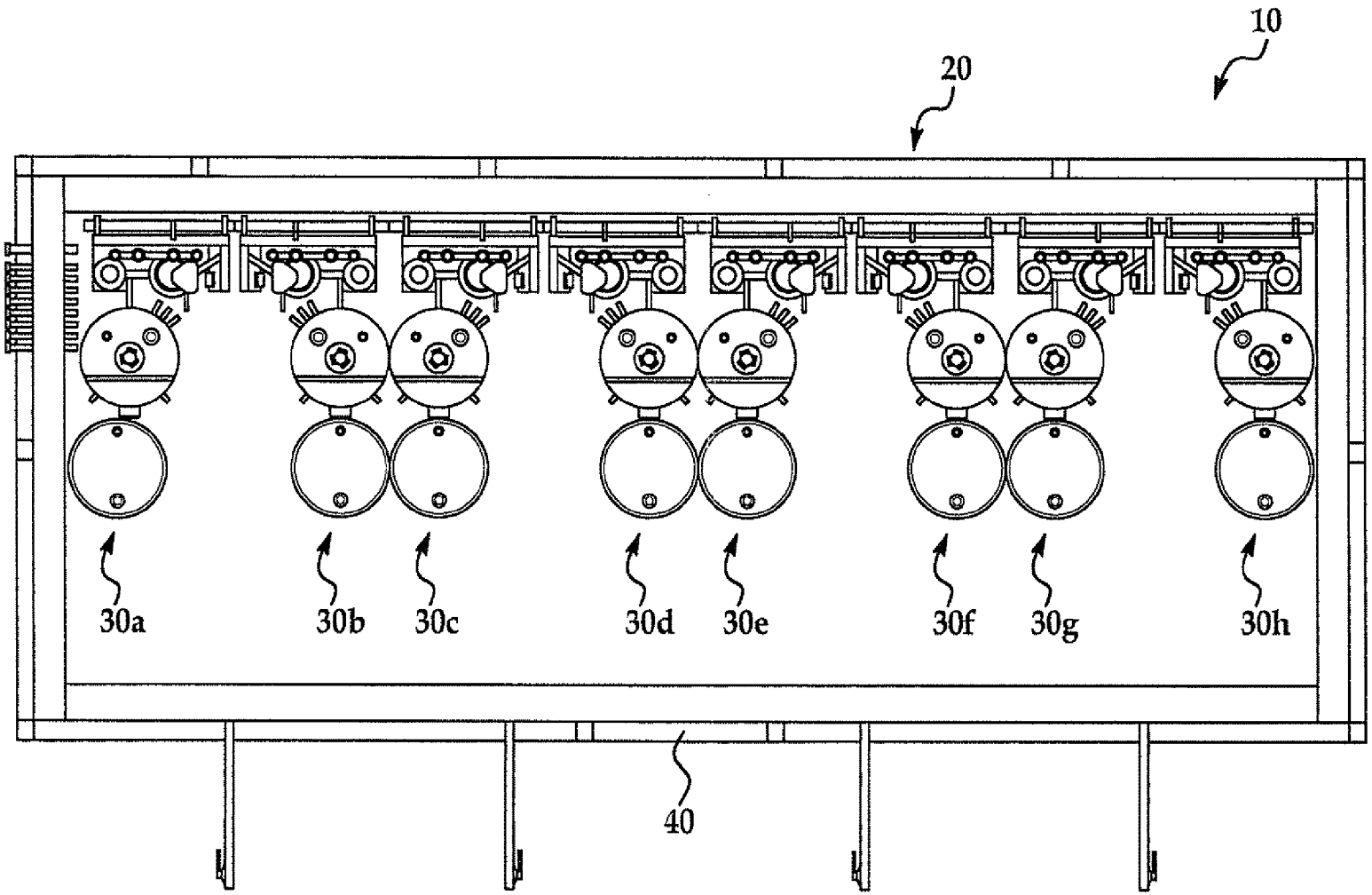
FIG. 2 is a plan view of the system shown in FIG. 1.

FIG. 1 is a perspective view of an illustrative implementation of a cost effective paint system 10. The modular continuous flow paint delivery system 10 includes at least one modular paint delivery system module 20, each module 20 with various paint circulation line components or systems 30 preassembled into operational units contained in an intermodal shipping container 40. In the example shown in FIG. 1 the modular continuous flow paint delivery system 10 includes eight paint delivery circulation line systems 30*a*-30*h* preassembled in a single intermodal shipping container 40, but any number of circulation line systems can be provided depending on the individual size of the paint delivery circulation line systems and the overall size of the intermodal shipping container. Optional power distribution systems, heating and/or cooling systems can be supplied, if desired. By way of example and not limitation, one of the power distribution systems can be a pre-wired electrical panel, a pre-piped hydraulic system with or without a hydraulic pump, or a pre-piped pneumatic system with or without a compressor, if desired.

Each of the continuous flow paint delivery modules 20 can include an intermodal shipping container 40 such that each may be assembled in a factory and then both shipped and deployed in the intermodal shipping container. The intermodal shipping containers 40 may be readily purchased, e.g., off the shelf, or may be custom or specially manufactured to standards for the intermodal shipping container industry with respect to, for example, size, maximum weight, lifting points, etc. Such use of standard modular shipping containers enables the paint delivery system modules to easily fit into existing worldwide air, road (e.g., truck), rail, and/or vessel (e.g., ship and barge) container handling infrastructure that also includes standardized container handling hardware. In addition, the standard intermodal shipping containers are relatively inexpensive and robust while large enough to contain a good amount of paint delivery system modules and/or self-contained power interconnection or conversion, heating/cooling, and other external onsite connectivity interfaces, etc. As the shipping container 40 and its contents are shipped in the container itself and deployed with minimum, if any, additional on-site configuration, the various components within the container can be secured within the container, e.g., to the walls, floor, ceiling and/or internal structure of the container and/or to each other. It should be appreciated that the standard intermodal shipping containers enjoy the convenience and cost savings associated with the existing container handling infrastructure.

By shipping and also deploying the paint delivery circulation line systems 30*a*, 30*b*, 30*c*, 30*d*, 30*e*, 30*f*, 30*g*, 30*h* in the intermodal shipping container 40, the components may be factory built and/or tested. Building and testing the paint delivery components in the intermodal shipping containers can be cost effectively achieved in a controlled environment of a centralized factory or other build facilities. Such factory building and testing reduces the cost and time associated with conventional installation at a site with site-specific requirements and constraints that would also otherwise involve costly skilled tradesmen, particularly to complete the build-out of power, heating and/or cooling systems. The paint delivery system components can also enjoy the cost savings associated with mass assembly. Completely building and testing the paint delivery components on the factory assembly floor also helps to reduce costly design and/or installation errors and helps to exploit economies of scale.

Complete operational system testing on the modular paint delivery system components can be performed by expert testing staff before the modular paint delivery system components are shipped from the factory. Many other elements that are usually beyond the paint delivery system customer's control can be easily monitored. The building of the modular paint delivery system components on the factory assembly floor would thus result in a better and also more consistent end product.

The use of modular paint delivery system components allows for design standardization and a greater amount of control over the assembly and testing processes. The design costs of such paint delivery systems can be amortized over a large number of modular paint delivery system components versus the conventional approach that takes into account site-specific constraints and even separate areas within a site.

The use of continuous flow paint delivery system modules can also substantially reduce the time to build, install and startup a system. Modular components are particularly suited for deploying smaller paint delivery systems in remote locations and can benefit from using one or more modular components of a modular continuous flow paint delivery system.

The modular continuous flow paint delivery system 10 can be located where real estate is inexpensive such as in former industrial sites, in a yard with a stable and graded surface, at sites near power dams and/or railways with, for example, access to resources such as electricity, natural gas (e.g., for power generation), compressed air, and/or hydraulic power. After the paint delivery system modules 20 reach the customer's site, the components may then be easily and efficiently connected to electrical, natural gas, water, and/or other connections and/or to each other to form the modular paint delivery system 10. The resource hookups may be industrial standard quick connects such that the modular paint delivery system and/or each modular component can be quickly and easily installed and removed and/or the hookups can be automated. The paint delivery system modules 20 can also be stacked to conserve real estate. Thus the use of modular paint delivery system 10 eliminates many of the logistic difficulties inherent in building paint delivery systems at unique and distant sites, such as third world countries.

In one embodiment, each modular component can be a largely self-contained system. Each modular component can be assembled with the electrical distribution and controls required by the paint delivery components, e.g. pumps, valves, mixers, control panels, of the modular components. In some embodiments, the site installation involves only unloading of the modular component(s) from the delivery vehicles and connecting electricity, gas, water, and/or various other connections.

Figure 3:
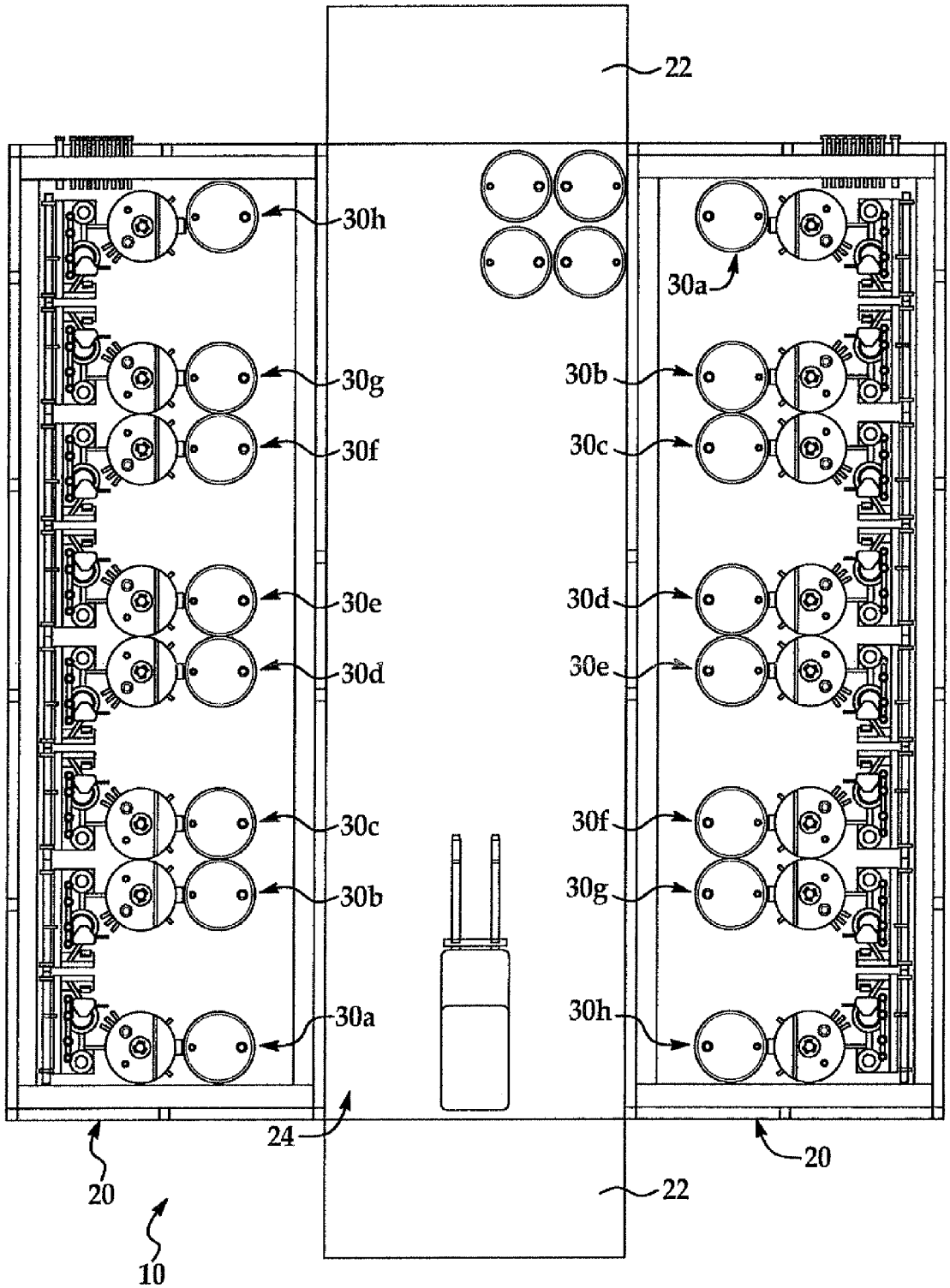
FIG. 3 is another illustrative implementation of a cost effective paint system.

By the nature of the modular components, the modular components can be sited within an existing building structure, outdoors exposed directly to the elements, under an overhead protective car-port style roof structure, and/or various other combinations. As shown in FIG. 3, multiple modules 20 with various circulation line components can optionally be connected to each other via ramps 22 or paths 24 allowing human and/or hi/low forklift access within the individual intermodal shipping containers located on site. If desired, modules 20 can be connected via a system of additional modules acting as interconnecting hallways, offices, and/or convenience facilities for the use of service employees.

Once deployed, each modular component can be serviced on site with human and/or forklift access. Alternatively or additionally, an entire intermodal shipping container can be conveniently and easily disconnected and transported to a different location or to a service center where the modular components can be tested, repaired, replaced, recycled, etc. It is noted that the paint delivery system is well suited to be a used in either an industrialized large scale deployment of standardized equipment and/or in remote small scale deployment of standardized equipment in less developed countries.

Figure 4:
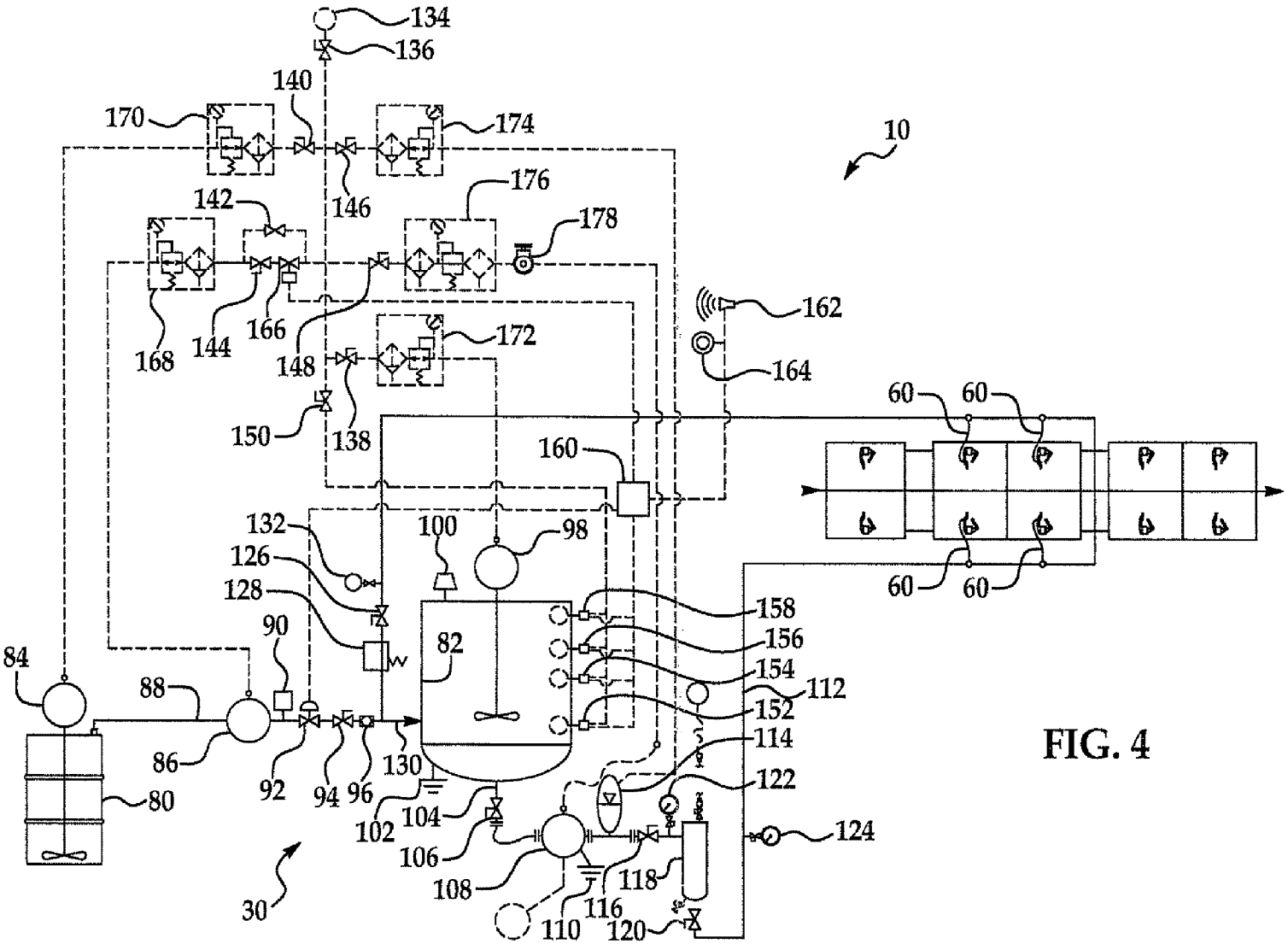
FIG. 4 is an exemplary piping and control schematic of a single continuous flow paint circulation line or paint delivery system.
Figure 5:
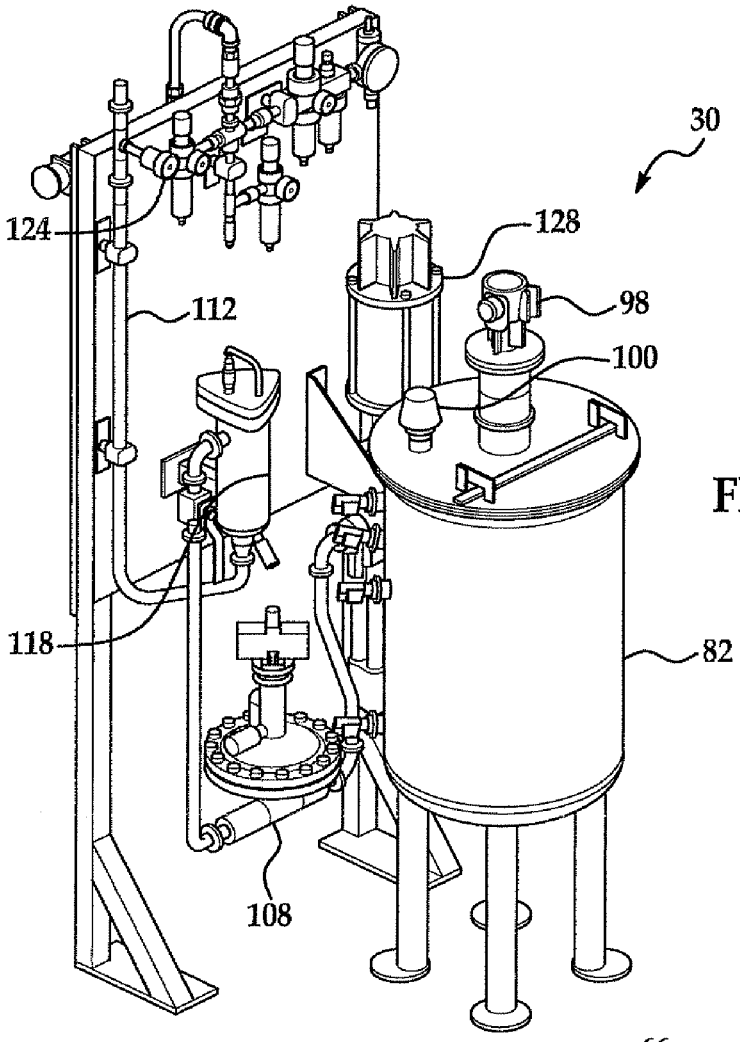
FIG. 5 is a perspective view of exemplary single continuous flow paint circulation line components or paint delivery system preassembled within the shipping container.

Referring now to FIGS. 4-5, by way of example and not limitation, a typical paint delivery circulation line system is depicted. The cost effective paint circulation systems according to one embodiment of the present invention can use state of the art pneumatic controls and fluid dynamics to reduce cost of operation while providing dedicated delivery. The system is designed for continuous delivery of material 24 hours per day and 7 days per week. Dedicated colors can be provided. The system can provide reduced system components. A one pipe, piggable system header design can provide simplified cleaning and maintenance. The system is designed to run with low energy costs and for ease of operation. Quick color changes, no settling, expandable booth/drop, low paint load, portable, low cost, and reduced time and material to clean the system are some of the advantages of the continuous flow paint delivery system 10.

In a traditional paint circulation system design, paint velocity of 60 feet per minute is provided through the headers and drops to prevent settling of solvent borne paints. The traditional system typically a two pipe hydraulically balanced system with large capacity components, requiring large volumes to fill, large tanks, and large agitators. A 20 drop station traditional system would require 10 to 15 gallons per minute of continuous flow. Electric power requirements for pump and agitators can total 7 horsepower.

By comparison, the system 10 illustrated in FIGS. 1-5 can provide a one pipe system design with velocity of 10 feet per minute to 30 feet per minute for waterborne paint through the header. The system 10 can use small components requiring small tanks and low volumes to fill. A twenty drop station system 10 can require 1 gallon per minute to 2 gallons per minute of continuous flow. The illustrated exemplary system can use an pneumatic piston pump, pneumatic tank agitator, and pneumatic tote/drum agitator for a total consumption of approximately 15 SCFM or total of 3 horsepower. The continuous flow paint delivery system 10 according to an embodiment of the present invention for hazardous mix rooms can include one or more of the following features: Factory Mutual (FM) approval; 2 hour fire-rated non-combustible construction; air inlet vents can be equipped with 2 hour UL classified fire dampers; UL classified 2 hour fire-rated double doors with UL listed frame and hardware; active door equipped with self-closer, security lock, and interior safety release; dry chemical fire protection; chemical resistant coated surface; secondary containment sump with galvanized steel floor grating; open channel base construction for visual inspection; crane/forklift openings; static grounding systems; hold-down brackets; and/or hazard placards and labeling.

Figure 6:
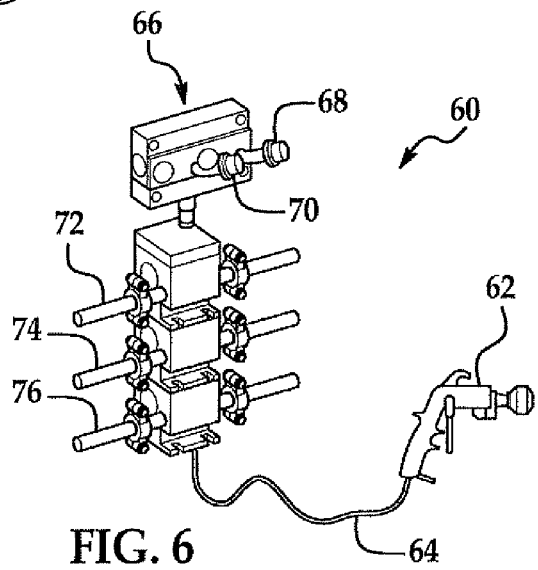
FIG. 6 is a simplified schematic of a typical manual spray gun drop to be provided at the installation site for connection to each of the individual modular continuous flow paint delivery systems located with the shipping container.

Referring briefly to FIG. 6, by way of example and not limitation, a typical installation site includes a plurality of manual paint drops 60 connected to a spray gun 62 by hose 64. Each drop 60 includes a color change valve 66 connected to a compressed air header 68, a solvent header 70, a first main paint color line 72, a second main paint color line 74 and a third main paint color line 76. Any number of main paint color lines can be provided as desired depending on the application. Operation of the system to effect a color changeover is known and will not be described in detail here.

Referring again to FIGS. 4-5, a plurality of drops 60 are supplied by the continuous flow paint delivery system 10. A plurality of paint circulation line systems, generically identified as numeral 30 in FIGS. 4-5, generally corresponds to any one of the systems 30*a*-30*h* illustrated in FIGS. 1-3 typically installed in each shipping container 40 to define an individual module 20 to be shipped and installed at the customer's site. As best seen in FIG. 4, a drum or tote 80 of material to be circulated is delivered to the module 20 by hand or forklift and positioned adjacent a corresponding receptacle 82. The drum or tote 80 can be connected to an agitator 84 and a pump 86 to transfer material from the drum or tote 80 to the receptacle 82. The transfer piping 88 can include a pressure switch 90, an actuated ball valve 92, a ball valve 94, and a check valve 96 connected to an inlet port 130 of the receptacle 82.

The receptacle 82 can include an agitator 98 and an inlet vent filter 100 allowing the receptacle to be kept at atmospheric pressure. The receptacle is electrically grounded at 102. An outlet port 104 of the receptacle 82 is connected through a ball valve 106 to circulation pump 108. Pump 108 is electrically grounded at 110 and circulates material through supply header 112, passing through pressure surge protector 114, first ball valve 116, filter 118, and second ball valve 120. An upstream pressure gauge 122 and downstream pressure gauge 124 can display or measure the pressure drop across the filter 118.

The supply header 112 loops past various, typically remote, points of material application depending on the material being circulated, by way of example and not limitation, such as primer coat application, base coat application, clear coat application, etc. and returns in a closed loop to the receptacle 82 through ball valve 126 and back pressure regulator 128 and inlet port 130. A return line pressure gauge 132 can display or measure the pressure in the return portion of supply header 112.

Compressed air is provided through supply pipe 134. The compressed air supply pipe 134 is provided with various isolation ball valves 136, 138, 140, 142, 142, 144, 146, 148, 150. Isolation valve 138 supplies compressed air to pneumatic level sensors 152, 154, 156, 158 corresponding to abnormally low alarm level, low start transfer pump level, high stop transfer pump level, and abnormally high alarm/shut ball valve level, respectively.

Control box 160 receives signals from the pneumatic level sensors and, based on the signals received and the program or control sequence, responds to an abnormally low level 152 or an abnormally high level 158 by sounding an audible alarm 162 and/or a visual signal 164. If the signal indicates an abnormally high level 158 in receptacle 82, the control box 160 also closes actuated ball valve 92 to isolate the receptacle 82 from any additional material being supplied by transfer pump 86. During normal operation, the control box 160 operates the transfer pump 86 when the material level in the receptacle reaches the low level sensor 154 and stops the transfer pump 86 from operating when the material level in the receptacle 82 reaches the high level sensor 156. The transfer pump 86 is controlled through solenoid valve 166 and filter regulator 168. The preassembled interconnected piping located inside the container 40 for all paint lines, controls, and utilities is completed at the factory build site, and the complete operational units are tested prior to shipping as part of the internal modular build process.

The transfer pump can be disabled by closing isolation valves 142 and 144. Isolation valve 140 can be closed to disable drum/tote agitator 84 and corresponding filter regulator 170. Isolation valve 150 can be closed to disable receptacle agitator 98 and corresponding filter regulator 172. Isolation valve 146 can be closed to disable or isolate pressure surge protector 114 and corresponding filter regulator 174. Isolation valve 148 can be closed to disable circulation pump 108, corresponding filter regulator lubricator 176, and runaway valve 178.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A cost effective paint system comprising:

at least one modular paint delivery system module, each module including:

a shipping container configured for transport via a transport infrastructure; and a plurality of paint delivery systems preassembled into separate, individual operational paint circulation units and interconnected to internal control and power distribution systems located within the shipping container and configured to be shipped and operated within the shipping container after being connected to external resources and distribution piping located on site.

2. The cost effective paint system of claim 1, wherein the plurality of paint delivery systems are arranged within the shipping container to define at least one access way within the corresponding shipping container to provide forklift access to the plurality of paint delivery systems.

3. The cost effective paint system of claim 1, wherein the plurality of paint delivery systems are arranged within the shipping container to define at least one access way within the corresponding shipping container to provide human access to the plurality of paint delivery systems.

4. The cost effective paint system of claim 1, wherein the plurality of paint delivery systems include components installed on support structures connected to an integral structural component of the shipping container.

5. The cost effective paint system of claim 1, wherein the transport infrastructure is an intermodal transport infrastructure and wherein each shipping container is configured for transport via the intermodal transport infrastructure.

6. The cost effective paint system of claim 1, wherein each shipping container is configured in accordance with International Organization for Standardization (ISO) container manufacturing standards for transport via the intermodal transport infrastructure.

7. The cost effective paint system of claim 1 further comprising:

an interconnecting module to interconnect a plurality of the modular paint delivery system modules, the interconnecting module including another intermodal shipping container.

8. A method for deploying a cost effective paint system comprising:

building at least one modular paint delivery system module at a first site, each paint delivery system module including:

a shipping container configured for transport via a transport infrastructure; and a plurality of paint delivery systems preassembled into separate, individual, operational paint circulation units and interconnected to internal control and power distribution systems located within the shipping container and configured to be shipped to and operated within the shipping container after being connected to external resources and distribution piping located on site;

transporting the at least one modular paint delivery system module to an installation site location different from the first site via the transport infrastructure; and connecting at least one resource connection and at least one distribution piping to the at least one modular paint delivery system module at the installation site location.

9. The method of claim 8, wherein at least one resource connection is selected from the group consisting of electricity, natural gas, water, hydraulic, and pneumatic.

10. The method of claim 8 further comprising:

testing each paint delivery system of each modular paint delivery system module at the first site.

11. The method of claim 8, wherein transporting via the transport infrastructure includes transporting via at least one of air, road, rail, and vessel.

12. The method of claim 8, wherein each paint delivery system includes components arranged within the shipping container to define an access way within the corresponding shipping container to provide forklift access to the continuous flow paint delivery systems.

13. The method of claim 8, wherein each paint delivery system includes components arranged within the shipping container to define an access way within the corresponding shipping container to provide human access to the continuous flow paint delivery systems.

14. The method of claim 8 wherein building includes installing components of each paint delivery system on support structures connected to an integral structural component of the shipping container.

15. The method of claim 8 further including servicing the paint delivery systems by one of:

performing on-site maintenance at the installation site; and transporting the at least one modular paint delivery system module to a site different from the installation site via the transport infrastructure.

16. The method of claim 8 further comprising:

transporting the at least one modular paint delivery system module to a second site different from the installation site via the transport infrastructure.

17. The method of claim 8, wherein the transport infrastructure is an intermodal transport infrastructure and wherein each shipping container is configured for transport via the intermodal transport infrastructure.

18. The method of claim 8, wherein each shipping container is configured in accordance with International Organization for Standardization (ISO) container manufacturing standards for transport via the intermodal transport infrastructure.

19. A cost effective paint system comprising:

a modular continuous flow paint delivery module including:

a shipping container configured for transport via a transport infrastructure with respect to at least one of height, length, width, weight, and lifting points of the container; and a plurality of continuous flow paint delivery systems preassembled into operational paint circulation units and interconnected to internal control and power distribution systems located within the shipping container and configured to be shipped and operated within the shipping container after being connected to external resources and distribution piping located on site.

20. The cost effective paint system of claim 19, wherein the transport infrastructure is an intermodal transport infrastructure and wherein each shipping container is configured for transport via the intermodal transport infrastructure, and each shipping container is configured in accordance with International Organization for Standardization (ISO) container manufacturing standards for transport via the intermodal transport infrastructure.

* * * * *